United States Patent [19]

Spring

[11] 4,266,767

[45] May 12, 1981

[54] COMPETITIVE CAPTURE GAME

[75] Inventor: Gorden W. Spring, Anaheim, Calif.

[73] Assignee: Tomy Kogyo Co., Inc., Tokyo, Japan

[21] Appl. No.: 61,811

[22] Filed: Jul. 30, 1979

[51] Int. Cl.[3] ..... A63F 9/00

[52] U.S. Cl. ..... 273/1 R

[58] Field of Search ..... 273/1 R, 1 E, 1 M, 412

[56] References Cited

U.S. PATENT DOCUMENTS

| | | | |
|---|---|---|---|
| 3,112,929 | 12/1963 | Gisser | 273/1 E |
| 3,474,771 | 10/1969 | Breslow et al. . | |
| 3,583,702 | 6/1971 | Glass et al. | 273/1 M |
| 3,679,208 | 7/1972 | Carrano, Jr. et al. | 273/412 |
| 3,810,629 | 5/1974 | Yamamoto . | |
| 3,973,774 | 8/1976 | Breslow et al. . | |
| 4,119,312 | 10/1978 | Todokoro . | |

*Primary Examiner*—Paul E. Shapiro

*Attorney, Agent, or Firm*—K. H. Boswell; Edward D. O'Brian

[57] ABSTRACT

A competitive game for play between two players has a support structure which is capable of holding a multiplicity of loose objects. The objects are located on the support structure within a containing framework which includes a centralized holding member and a plurality of locating members. The locating members are activated by appropriate player controls causing the objects to be continually agitated until one of the objects becomes located within a holding member. Each player using a separate control also controls a capture member. When an object is correctly positioned within the holding member each player attempts to capture the object in his capture member before the other player can do the same. After one object is successfully captured the players then attempt to reposition a second object within the holding member to repeat the capture sequence.

12 Claims, 7 Drawing Figures

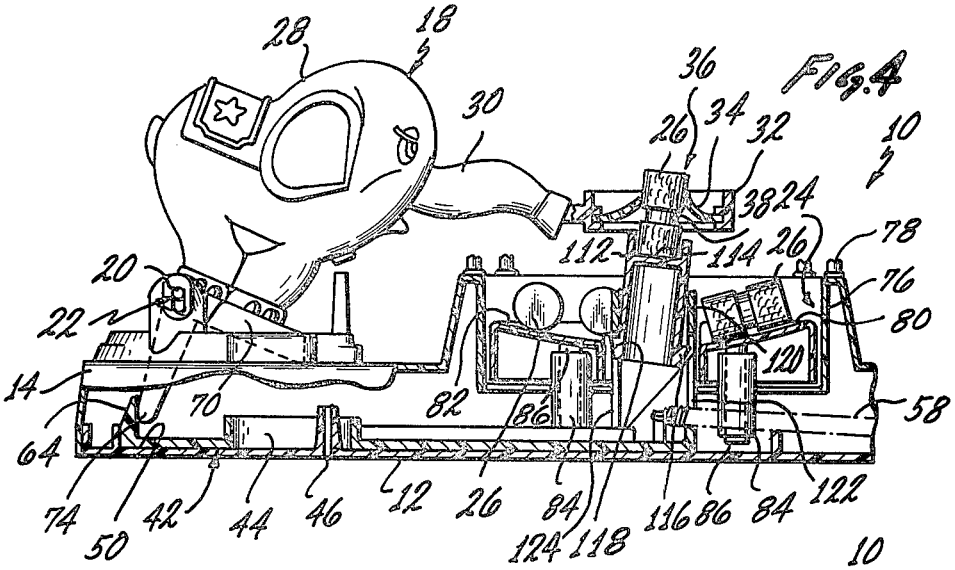
Fig. 4
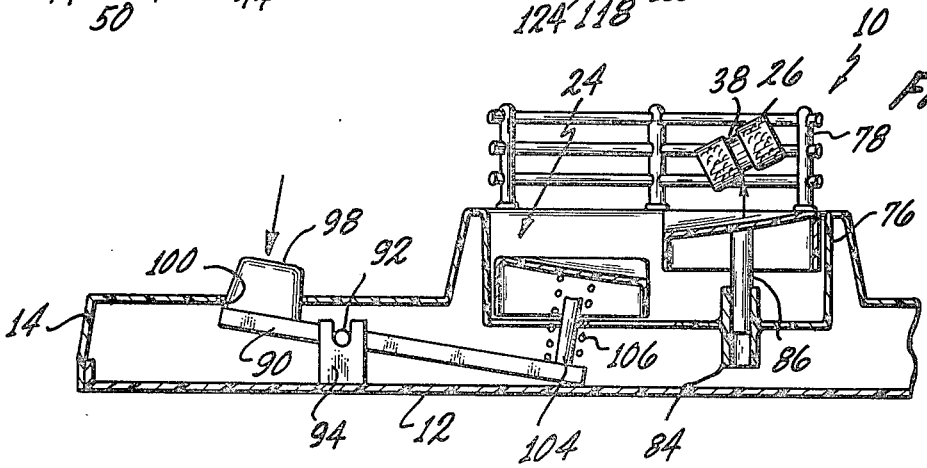
Fig. 5
Fig. 6
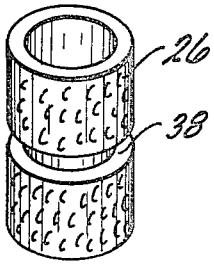
Fig. 7
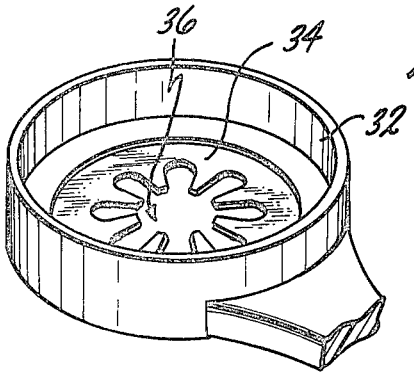

COMPETITIVE CAPTURE GAME

BACKGROUND OF THE INVENTION

This invention is directed to a competitive game between players wherein each player of the game attempts to capture one of a multiplicity of loose objects with a capture member under his control.

The play value of competitive games is self-evident by the multiplicity of competitive games that are currently on the commercial market. Most of these games require that one player be in control of initiating play or launching an object for which the players compete. This gives this player an inherent advantage. If the object of the game is to capture a small object or implement, discord can arise among the players if the advantage of the person who launches the ball or object is overtly apparent to the other. If this happens the game is totally disrupted and the play value is, of course, lost.

Apparatuses are known which randomly, or at least seemingly randomly, will dispense or deposit a small object. Examples of this type of apparatus are those used in conjunction with bingo and other chance games. It is considered that a competitive game between two or more players which incorporates an apparatus which at least seemingly appears to select or deposit an object in a random manner such as the above mentioned bingo apparatus, would alleviate the seemingly inherent player advantage noted above in competitive games.

Certain game apparatuses are known such as those described in U.S. Pat. Nos. 3,474,771 and 3,973,774 which have platforms within an apparatus which are activated, i.e., caused to move up and down, such that they are capable of moving an object placed on their surface with enough velocity to expel the objects from a container which circumvents the platform. Another type of game is known such as that described in U.S. Pat. No. 4,119,312 in which players compete for an object located on a surface. Not known, however, is a game which incorporates both of these types of action into a single game. It is considered that a game that did incorporate both of these actions would have a considerable play value.

BRIEF SUMMARY OF THE INVENTION

In view of the above it is therefore an object of this invention to provide a game in which players can competitively compete with each other for an object but which simultaneously also incorporates means for causing the object to randomly be placed in a capture position wherein each player has the same chance as any other player to capture the object.

It is a further object to provide a game which fulfills this first object, yet is uncomplicated in its construction and operation such that it is both durable in use and can easily and economically be manufactured.

These and other objects are achieved by providing a competitive game having a supporting base and at least one object which is capable of freely moving on the supporting base. Included on the supporting base is an object positioning means which is capable of positioning and holding the object in a position wherein it can be captured. At least two capture means are movably mounted on the supporting base so that each is independently capable of capturing the object and removing it from its capturable position on the object positioning means. Further, each of the object capturing means is capable of interfering with the capture of the object of any of the other object capture means.

The object positioning means includes an object holding member capable of holding the object in its capturable position. Additionally the object positioning means includes an object locating means capable of locating the object in the holding member.

Each of the object capture means includes a capture member mounted on the support base and an activation means operatively connected to the capture member and capable of activating the capture member such that it will capture the object.

The object locating means includes at least one object locating member, preferredly more than one, capable of repositioning the object within the support base and including the capability of positioning or locating the object within the object holding member. A locating member activation means is operatively connected to each of the locating members and when activated by a player causes the object locating member to reposition the object.

BRIEF DESCRIPTION OF THE DRAWINGS

This invention will be better understood when taken in conjunction with the drawings wherein:

FIG. 4 is a side elevational view in partial section of a portion of the invention shown in FIG. 1 showing one member of the invention in a different orientation from that shown in FIG. 1;

FIG. 5 is a side elevational view in section of a portion of the invention taken about the lines 5—5 of FIG. 2;

FIG. 6 is an oblique view of a movable object used with the invention; and

FIG. 7 is an oblique view of a portion of the invention located at the extremity of the trunk of the animated elephant shown in FIG. 1.

Figure 1:
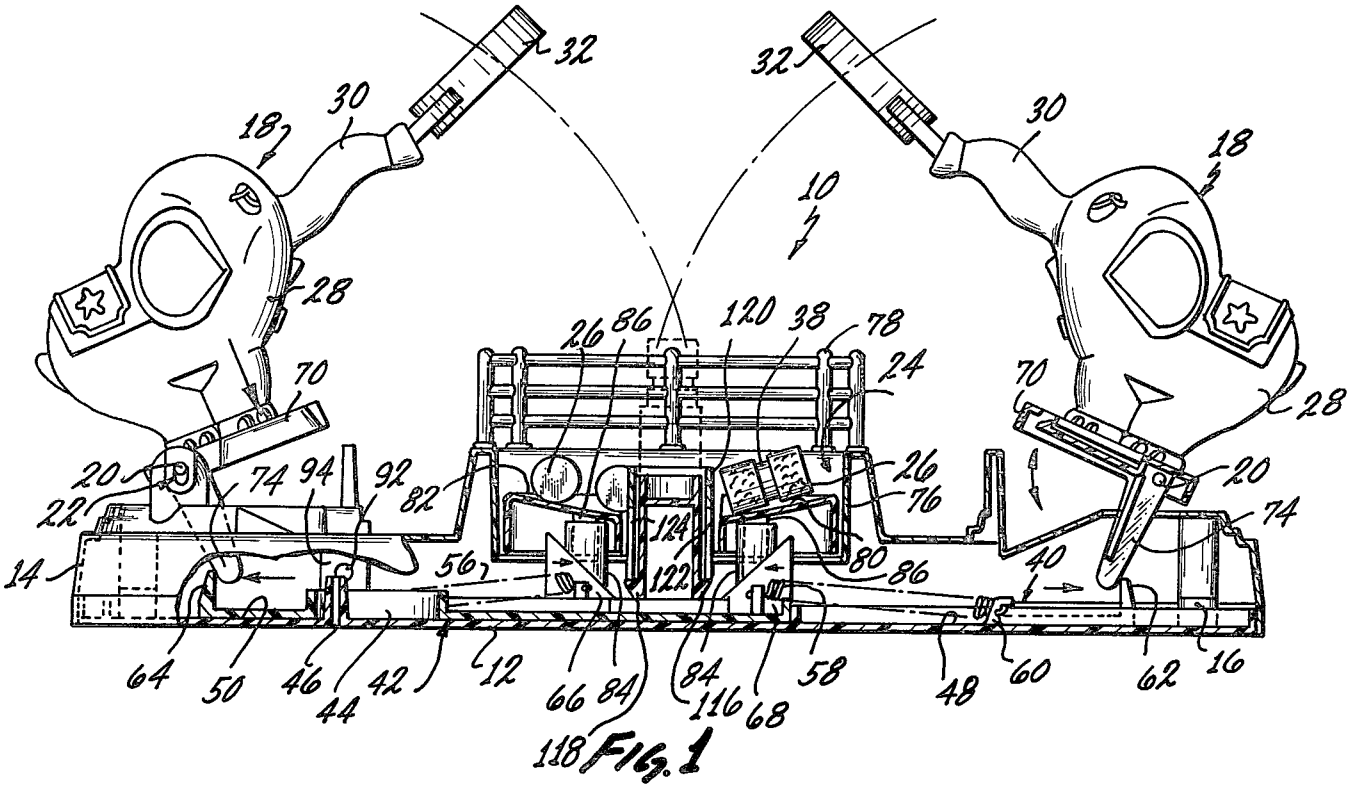
FIG. 1 is a side elevational view in partial section.

The invention shown in the drawings and described in the specification utilizes certain principles and concepts as are set forth and defined in the appended claims forming a part of this specification. Those skilled in the toy art will realize that these principles and concepts could be utilized in a number of differently appearing embodiments. For this reason, this invention is not to be construed as being limited to the particular embodiment shown in the figures and described in the specification, but is to be construed in light of the appended claims.

DETAILED DESCRIPTION

The toy 10 shown in the figures has a main support or bottom base 12 to which an upper housing 14 is attached. The upper housng 14 fits over the base 12 and is retained thereon by a number of screws (not separately shown or identified) which project through a plurality of hollow bosses 16 appropriately located on the bottom base 12. Two identical object capture members 18 are pivotally mounted to the upper housing 14 via identical axles 20 which fit into appropriate bearings 22.

An object container 24 is centrally located within the upper housng 14 and a plurality of identical objects 26 are located therein at the start of the game. It is the broad object in playing the game to capture as many of the objects 26 as possible with the object capture member under the control of each player.

The object capture members 18 consist of a body 28 having an appropriate extension 30 to which is attached a capture disk 32. A rubber insert 34 fits within the interior of the capture disk 32 and has a spider-like opening 36 in its center. The spider-like opening 36 has a central hole (not separately numbered) which is of a smaller diameter than the diameter of the cylindrical objects 26. The cylindrical objects 26 have a central groove 38 located midway between the end of the objects. The diameter of the outside surfaces of the groove 38 is also greater than the diameter of the central hole within the opening 36. Thus the objects 26 have what could be best described as a distorted dumbbell shape, the function of which will be better understood after further describing the capture of these objects 26 by the capture members 18 hereinafter.

Slidably located on the bottom base 12 are two slide members, right slide member 40 and left slide member 42. Slide members 40 and 42 are compound members having a cutout collectively identified by the numeral 44, on each member which fits over identical upstanding bosses collectively identified by the numeral 46, located within right slide track 48 and left slide track 50. The right slide member 40 fits within the right slide track 48 such that its appropriate boss 46 is located within the appropriate cutout 44. A right side retaining lip 52 and a left side retaining lip 54 serve to hold the slide members 40 and 42 in proper position within the tracks 48 and 50. A spring 56 biases right slide member 40 toward the center of the bottom housing 12 and likewise, an identical spring 58 biases the left slide member 42 also toward the center of the base 12. These two springs 56 and 58 are appropriately attached to two identical peg members 60 projecting upwardly from the base 12.

Figure 3:
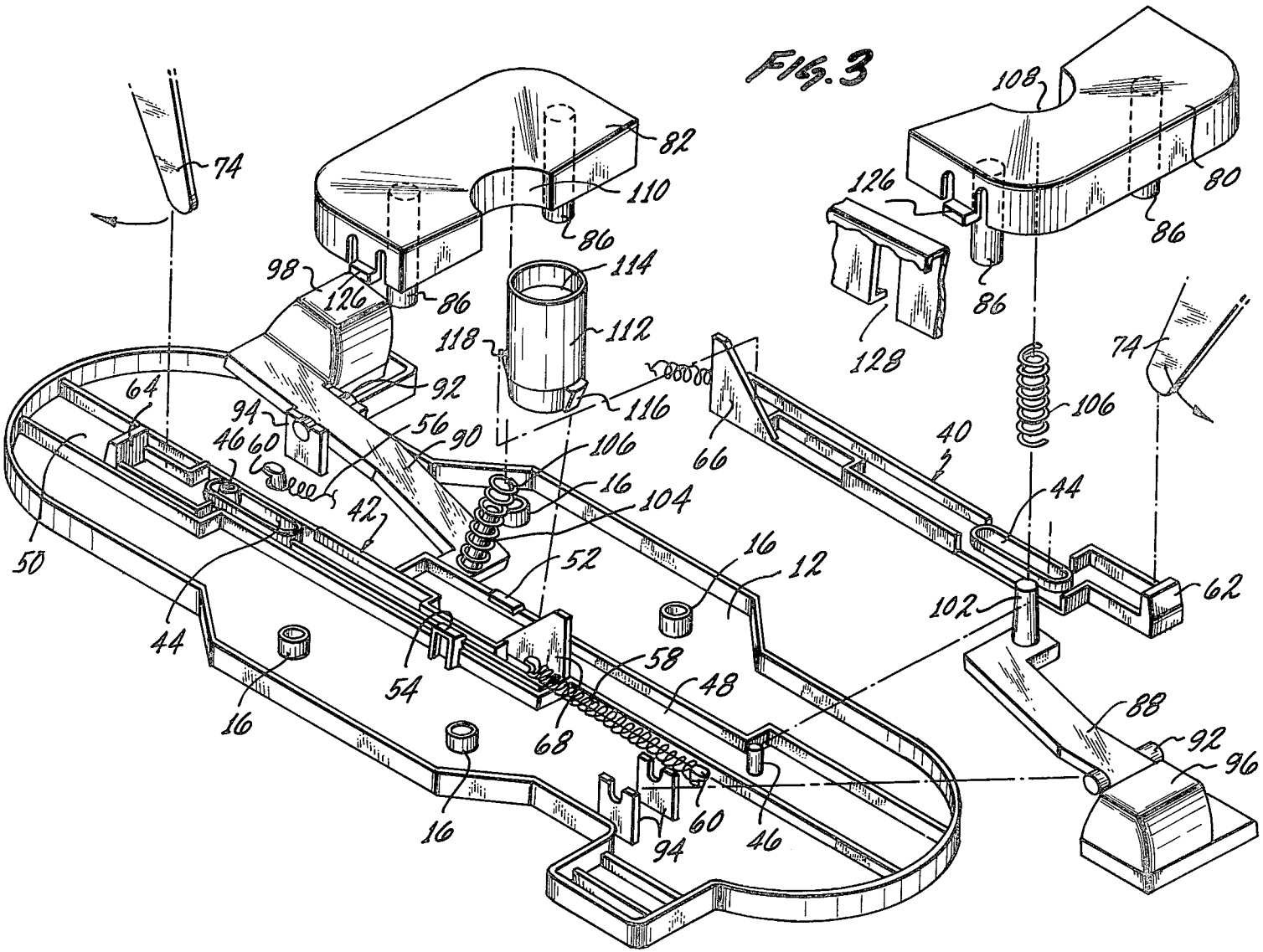
FIG. 3 is an exploded isometric view of certain of the internal components of the invention.

As seen in FIG. 3 right slide member 40 has a detent finger 62 located on its right hand side and correspondingly, left slide member 42 has a detent finger 64 located on its left hand side. An angle member 66 is located on the other end of right slide member 40 and an identical angle member 68 is located on left slide member 42, the function of which will be described hereinafter.

Each of the object capture members 18 includes a base plate 70 having a player activating button 72 integrally formed thereon and located on one side thereof. Projecting downwardly from the base plate 70 is an arm 74. Each of the arms 74 on the two object capture members 18 fit against one of the detent fingers 62 or 64 respectively. This is best seen in FIGS. 1 and 4. In the position shown in FIG. 1 the springs 56 and 58 have biased the end of slide members 40 and 42 on which detent fingers 62 and 64 are located toward the center of the toy 10. This in turn causes the detent fingers 62 and 64 to push against the arms 74 rotating the object capture members 18 about the axles 20 such that the capture disks 32 are elevated as well as the button 72 on the base plate 70. In FIG. 4 when either of the buttons 72 are depressed the corresponding capture member 18 is rotated about its axle 20 causing its arm 74 to depress the respective detent finger 62 or 64 causing the respective slide member 40 or 42 to slide against the bias of either spring 56 or 58 causing the ends of slide member 40 or 42 on which detent fingers 62 and 64 are located to go toward one of the respective ends of the toy 10. As this happens the capture disk 32 descends downward toward the center of the toy 10 as shown in FIG. 4. Additionally, the angle members 66 or 68 move toward the center of the toy and interact with an additional component as hereinafter described.

The object container 24 is defined by an upstanding two sided wall 76 which extends around the perimeter of the object container 24. This wall 76 is formed in upper housing 14 and as viewed in FIG. 2 from the top it has a generally square shape with round corners. Located on the top of wall 76 are two fence members, both collectively identified by the numeral 78. These extend around the object container 24 except for two spaces which are located below the capture disks 32 but cannot be seen in FIG. 2 because they are hidden by the capture disks 32. The spaces allow extensions 30 on the object capture members 18 to descend below the upper periphery of the fence member 78 allowing the capture disk 32 to assume a capture position as hereinafter described.

The floor of the object container 24 is movable and is made up of two pieces, right side floor piece 80 and left side floor piece 82. Four identical bosses 84, two of which can be seen in FIGS. 1 and 4, extend downwardly from upper housing 14. Each of the floor pieces 80 and 82 have two locating pegs collectively identified by the numeral 86 extending from their bottom surface. The locating pegs 86 slide within the bosses 84 and retain the right and left floor pieces 80 and 82 within the object container 24 but allow them to slide up and down with respect to the upper housing 14.

Identical right side floor activation member 88 and left side floor activation member 90 are used to raise and lower the floor pieces 80 and 82. Each of the members 88 and 90 are first class levers having a journal 92 appropriately located intermediate the ends of the levers. Identical bearing supports 94 project upwardly from the bottom of base 12. The activation members 88 and 90 rest on these bearing supports and are movable thereon. On the right hand side of right floor activation member 88 is right activation button 96 and likewise, on the left member 90 is left activation button 98. These two buttons 96 and 98 project through appropriate cutouts 100 in the surface of upper housing 14 which expose the buttons 96 and 98 to the players of the game.

Figure 2:
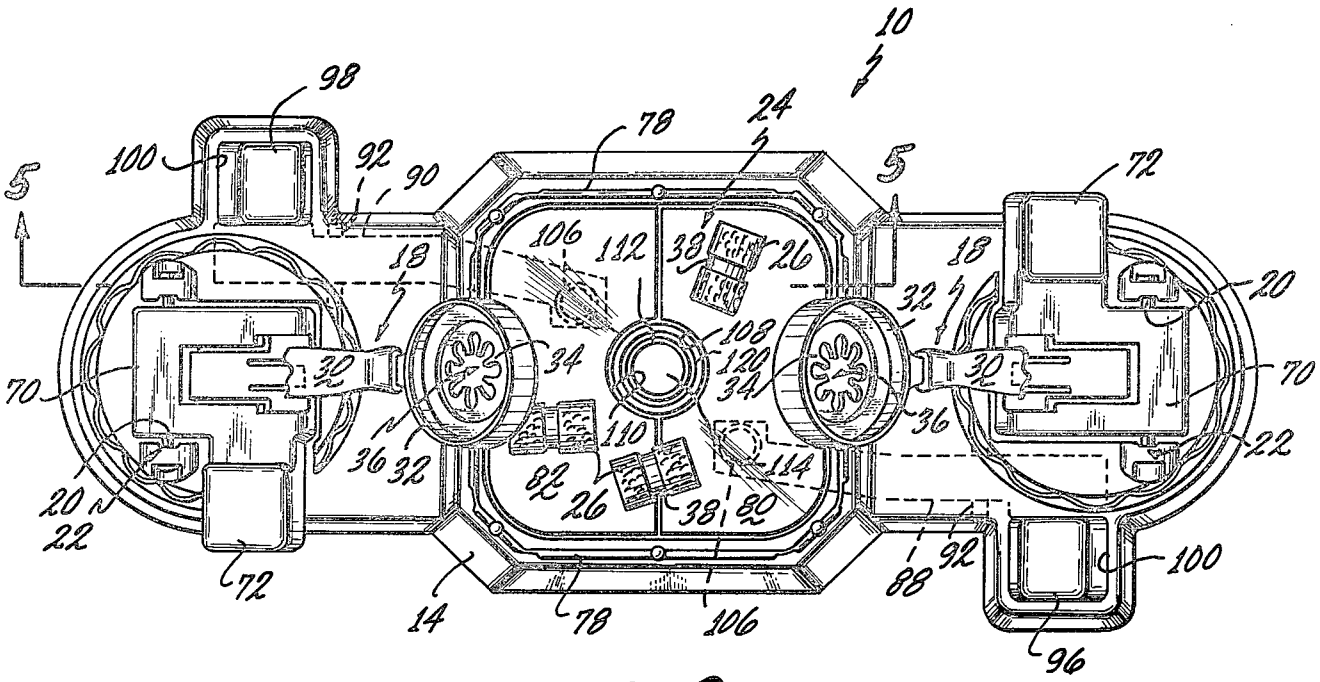
FIG. 2 is a top plan view of the invention.

As seen in FIG. 2 the buttons 96 and 98 are located on the side of each of the object capture members 18 opposite the activating buttons 72. An upstanding peg 102 is mounted on the other end of member 88 and an identical peg 104 is mounted on member 90. Each of the pegs 102 and 104 have an identical spring 106 fitting over them. The springs 106 are compression springs and in their extended state are longer than the pegs 102 and 104. Thus, when the springs 106 are slipped over the pegs 102 and 104 the springs 106 extend upwardly beyond the pegs.

The activation members 88 and 90 are located on the bottom base 12 such that the pegs 102 and 104 and their springs 106 resting on them are located beneath the right and left floor pieces 80 and 82 respectively. When right activation member 88 is activated by depressing button 96 peg 102 and its spring 106 are lifted causing right floor piece 80 to ascend. When the button 96 is no longer depressed the right floor piece 80 correspondingly descends. The spring 106 about peg 102 allows the floor piece 80 to vibrate slightly on both the ascending and descending pathways and also serves to absorb the shock when the floor pieces are stopped in their uppermost position as hereinafter described. Likewise, the floor piece 82 is under control of left button 98.

Each of the floor pieces 80 and 82 contain a hemispheric cutout 108 and 110, respectively, in their surfaces. Together, the two cutouts 108 and 110 form a circular cutout in the center of object container 24. Extending upwardly through the cutouts 108 and 110 are two round members, one an object holding member 112. The object holding member 112 is an elongated cylinder having a spacer 114 near its upper surface. The object holding member 112 is sized such that an object 26 will fit within its circular walls and rest on top of the spacer 114. On the bottom of object holding member 112 spaced 180° apart from each other are two wedge-like projections 116 and 118. The second round member extending through the cutouts 108 and 110 is an object holding member guide tube 120. It is integrally formed with upper housng 14. This guide tube 120 has a slot 122 and 124 on either side in which the wedge-like projections 116 and 118 slide in as the object holding member 112 slides within the guide tube 120 into which it is fitted.

The guide tube 120 projects upwardly through the cutouts 108 and 110 and when the right and left floor pieces 80 and 82 are in their normal position both the guide tube 120 and the object holding member 112 are exposed above the surface of the floor pieces 80 and 82. When the floor pieces are elevated to their utmost extreme they come even to the top of the guide tube 120.

The wedge-like projections 116 and 118 are positioned within the slots 122 and 124 such that when the right and left slide members 40 and 42 are slid along the bottom base 12 the angle members 66 and 68 on the slide members abut against the wedge-like projections 116 and 118 respectively on the object holding member. When either one or both of the angle members 66 and 68 come against their respective surfaces and impart an upward force vector against the wedges 116 and 118 which in turn causes object holding member 112 to lift up within guide tube 120.

In playing the game a plurality of objects 26 are deposited within the object container 24. Each of the players on the right and left side of the game respectively depress and release buttons 96 and 98 causing floor pieces 80 and 82 to move up and down. In addition to locating the floor pieces 80 and 82 in bosses 84 via locating pegs 86, each of the floor pieces 80 and 82 have a peg collectively identified by the numeral 126 located on either side. Four slots collectively identified by the numeral 128 in appropriate places in upper housing 14 are dimensioned slightly larger than pegs 126 and are located such that pegs 126 fit within the slots 128. When either of the floor pieces 80 and 82 is raised via depression of the appropriate button 96 or 98 the floor piece ascends until it is abruptly stopped by peg 126 coming to rest in the end of slot 128. At this time the springs 106 are depressed taking up the shock that is imparted to activation member 88 or 90 via buttons 96 or 98. The abrupt stopping of the floor pieces 80 or 82 by the interaction of pegs 126 with slots 128 cause the objects 26 located on the floor pieces 80 and 82 to be agitated and bounce up and down within the object container 24. With sufficient agitation one or both of the players alone or acting in concert can cause one of the objects 26 to become located in an upstanding position within the object holding member 112.

As soon as an object 26 comes to rest in the object holding member 112 no matter which player or both players resulted in its being located there, the object 26 within the object holding member 112 is now in a "capturable position" and becomes the target for both players to try and capture it with their object capture member 18. The players depress their respective capture buttons 72 causing their respective capture disks 32 to descend toward the object 26. As either or both capture buttons 72 are depressed the correspondng arm 74 associated with each capture button, either right or left, pushes against the corresponding detent finger 64 on either right or left slide member 40 or 42. The slide member, either 40 or 42, is caused to be slid toward either the respective right or left side of the game. This causes either one of angle members 66 or 68, or both of them almost simultaneously, to interact against wedge-like projections 116 and 118 lifting the object holding member 112 and the object 26 located thereon upwardly. The object holding member 112 can be raised by either or both players via buttons 72. Since angle members 66 and 68 moving against wedge-like projections 116 and 118 can independently or in concert cause object holding member 112 to be elevated.

Depending on each player's reaction time, one of the players will initiate capture of the object 26 with his object capture member 18 prior to the other. Both of the capture members 18, however, as noted above can descend toward the object holding member 112. When both capture members are activated their respective capture disks 32 will stack one on top of the other. When one or the other capture disks 32 hit the object located in the object holding member 112 the rubber insert 34 associated with that particular capture disk 32 "gives" allowing the object 26 to become lodged within the spider opening 36. Since the spider opening 36 is smaller than the smallest dimension across the groove 38 on the object 26 the rubber insert is always somewhat distorted as is depicted in FIG. 4. Further, the rubber insert 34 with an object 26 located within it can flex upward and downwardly. The object 26 will be held most securely within the rubber insert 34 when the spider opening 36 is around the groove 38 on the object 26.

Since the object holding member 112 is elevated no matter which of the capture disks 32 is closest to the object 26, it is possible for the object 26 to be pushed up through the lowermost of the capture disks 32 such that the second capture disk 32 located above the first capture disk 32 can in effect steal the object away from the lowermost capture disk. Thus, even if one player is successful at first locating an object 26 within his capture disk 32 he might not be able to retain it if the other player can forcibly cause his capture disk to push down on the object and steal it away. This feature adds an additional variable to the game.

I claim:

1. A toy which comprises:

a support base;

at least one object capable of freely moving on said support base;

an object positioning means located on said support base and capable of positioning and holding said object in a capturable position;

at least two object capture means movably mounted on said support base so as each to be independently capable of capturing said object and removing said object from said object positioning means;

each of said object capture means capable of interfering with the capturing of said object by said other object capture means.

2. The toy of claim 1 wherein:

said object positioning means includes an object holding member capable of holding said object in a position wherein independently any one of said object capture means can capture said object.

3. The toy of claim 2 wherein:

said object positioning means includes an object locating means capable of locating said object in said object holding member.

4. The toy of claim 3 wherein:

each of said object capture means includes a capture member movable mounted on said support base and a capture member activation means operatively connecting to said capture member such that when said capture member activation means is activated, said capture member moves toward said object holding member and is capable of interacting with an object within said object holding member and removing said object from said object holding member.

5. The toy of claims 3 or 4 wherein:

said object locating means includes at least one object locating member capable of repositioning said object within said support base and including positioning said object within said object holding member, a locating member activation means operatively connected to said locating member such that said locating member repositions said object upon activating said locating member activation means.

6. The toy of claim 5 including:

an object containing means located on said support base and containing said object so as said object is freely movable within said object containing means under the influence of said object locating member, and including said object holding member located within said object containing means.

7. The toy of claim 6 including:

an object holding member elevating means elevating said object holding member within said object containing means;

an elevating activation means independently operatively connected to each of said capture member activation means and elevating said object holding member when said capture member activation means is activated.

8. The toy of claim 7 wherein:

said object containing means comprises a continuous upstanding wall integrally formed on said support base and said object locating means comprises two object locating members located within said upstanding wall and movable within said upstanding wall agitating said object to reposition said object.

9. The toy of claim 8 wherein:

said object holding members comprises a movable upstanding cylinder located in the center of said upstanding wall and said object locating members each comprise a flat plate fitting within said upstanding wall and having an arcuate cutout in the surface of said flat plate such that said flat plates fit around said upstanding cylinder.

10. The toy of claim 9 wherein:

said elevation means includes said object holding member having at least one wedge projection projecting out of its cylindrical surface near the bottom of the object holding member;

at least one sliding member slidably mounted in said support base, said sliding member including an angular projection located on its surface such that said angular projection interacting with said wedge projection causing said wedge projection to slide on the surface of said angular projection imparting an elevating force to said object holding member;

said elevating activating means includes said capture member having an arm extending from its bottom surface, said arm interacting with said sliding member causing said sliding member to slide on said support base.

11. The toy of claim 10 wherein:

said capture member includes a capture disk having a circular rubber insert located within its periphery, said insert including a spider-like opening having a plurality of fingers capable of interacting and holding said object.

12. The toy of claim 11 wherein:

said object comprises a cylinder having a groove located intermediate the ends of said cylinder.

* * * * *